US006336231B1

(12) United States Patent
Smith

(10) Patent No.: US 6,336,231 B1
(45) Date of Patent: Jan. 8, 2002

(54) PORTABLE, UNIVERSAL, SELF-INFLATING BATHTUB LINER

(76) Inventor: Hermenie I. Smith, 297 Ocean Ave. #2B, Brooklyn, NY (US) 11225

( * ) Notice: Subject to any disclaimer, the term of this patent is extended or adjusted under 35 U.S.C. 154(b) by 0 days.

(21) Appl. No.: 09/474,538

(22) Filed: Dec. 29, 1999

(51) Int. Cl.[7] ..... A47K 3/02

(52) U.S. Cl. ..... 4/580; 4/583; 4/573.1; 4/582

(58) Field of Search ..... 4/580, 581, 582, 4/583, 573.1, 506, 585; 5/713, 945, 946

(56) References Cited

U.S. PATENT DOCUMENTS

| | | | | | |
|---|---|---|---|---|---|
| 2,672,628 | A | * | 3/1954 | Spanel | 5/713 |
| 4,023,220 | A | | 5/1977 | Younker | 4/177 |
| 4,068,326 | A | | 1/1978 | Deschler | 4/150 |
| 4,621,984 | A | * | 11/1986 | Fussell | 417/234 |
| D293,363 | S | | 12/1987 | Everard | D23/277 |
| 4,754,502 | A | | 7/1988 | Bowen | 4/487 |
| 4,970,734 | A | * | 11/1990 | Friedman et al. | 4/580 |
| 5,040,252 | A | | 8/1991 | Taggart | 4/580 |
| D337,814 | S | | 7/1993 | Rogers et al. | D23/281 |
| 5,839,132 | A | * | 11/1998 | Rooney | 4/582 |

* cited by examiner

*Primary Examiner*—Robert M. Fetsuga
*Assistant Examiner*—Khoa Huynh
(74) *Attorney, Agent, or Firm*—John D. Gugliotta

(57) ABSTRACT

An inflatable liner for use with conventional bathtubs is disclosed. For use with infants, elderly, physically disabled, or other instances where a cushioned and/or sanitary bathing surface is desired. A battery operated air pump is attached to the inflatable liner via small plastic tubes. The air pump is used to inflate the liner. The present invention also has an air trap valve to prevent overinflation. The inflatable liner is composed of separate air reservoir tubes that conform to the shape of the bathtub, surrounding the entire interior surface area of the bathtub. Once inflated, the actual tub itself provides the present invention with its shape and rigidity A convenient drainage hole with cover is incorporated into the inflatable liner, which allows the user to drain water out of the invention and bathtub before the present invention is removed from the tub and stored.

8 Claims, 4 Drawing Sheets

PORTABLE, UNIVERSAL, SELF-INFLATING BATHTUB LINER

RELATED APPLICATIONS

The present invention was first described in Disclosure Document No. 407,834 filed on Nov. 15, 1996. There are no previously filed, nor currently any co-pending applications, anywhere in the world.

BACKGROUND OF THE INVENTION

1. Field of the Invention

The present invention relates generally to bathing devices and, more particularly, to a portable, universal, self-inflating, bathtub liner which conforms to the contours of a bathtub and is used in bathing.

2. Description of the Related Art

The previous art consists of numerous devices designed to assist in the bathing function. Each of these devices is designed for a specific purpose. For example, U.S. Pat. No. 4,754,502, issued in the name of Bowen, discloses an outdoor, inflatable Jacuzzi-type device. The '502 device is a very large, self-standing inflatable device that is specifically designed to be used in a pool or on a patio. In addition, there are problems with the '502 design. It is expensive, bulky, and of complicated design, requiring the use of steam generators, water pumps, filters, and an electric motor. Thus, this device is obviously not designed for use with a traditional bathtub for daily bathing with soap and water.

Similarly, other devices are designed for another singular purpose. For example, U.S. Pat. No. 4,023,220, issued in the name of Younker, discloses an inflatable bathing tub for use in the shower. Once again, this device is designed for those who do not own or have access to a bathtub.

U.S. Pat. No. 4,068,326, issued in the name of Deschler, discloses an inflatable bathtub that is inflated about a bed. The device is specifically designed for the limited application of assisting nonambulatory, immovable individuals to take a bath while still in bed.

Another group of bathing devices are the self-standing inflatable bathtubs, illustrated by U.S. Design Pat. No. 337,814, issued in the name of Rogers et al., and U.S. Design Pat. No. 293,363, issued in the name of Everard. These devices have been used primarily for infants and have not found wide acceptance with adults. In addition, there are several problems associated with these devices.

First, these types of devices generally have no provision for filling and draining water. Because of this, it is a laborious and tedious job to manually fill the tubs with water. Second, during filling, the water becomes cold and the user uncomfortable. Third, users are likely to have difficulty entering and exiting the tub. The walls of these devices are not sturdy, and deform upon application of pressure. Thus, the likelihood of injury caused by falling is increased. This could be especially hazardous for the elderly, who are more likely to fracture bones upon falling. Fourth, these devices take up a large amount of space when in use, and do not conveniently and easily fold up for storage.

Fifth, the application of these devices is further limited by the fact that they offer no barrier to the spread of germs. Because the devices are bulky and expensive, it is unlikely that hotels and hospitals would provide each patient with a device. Thus, more than one individual would be using the device, which increases the likelihood of the spread of disease.

Furthermore, these devices are designed for a specific application, namely, as a substitute for the traditional bathtub. The devices are designed to be used by consumers who do not own a traditional bathtub.

Unrelated to the present invention are those bathtub liner devices, such as U.S. Pat. No. 5,040,252, issued in the name of Taggart, that are designed to protect the bathtub from impact damage during remodeling and construction in the bathroom. These devices are not designed to be used during bathing. In fact, these devices could not be used during bathing because the liner only covers the top of the bathtub, and does not cover the interior surface area of the tub.

A search of the previous art did not disclose any patents that read directly on the claims of the present invention.

Consequently, a need has been felt for providing an inflatable bathtub liner which addresses the problems of the previous art cited above.

SUMMARY OF THE INVENTION

It is therefore an object of the present invention to provide a portable, universal, self-inflating, bathtub liner which is inserted within a traditional bathtub, conforms to the contours of a traditional bathtub, is convenient and simple to assemble, use and disassemble, and provides physical safety as well as protection from the spread of germs.

The present invention is an inflatable liner that can be inserted into any traditional bathtub to provide a cushioned and sanitary environment. In its preferred embodiment, the present invention is constructed of a durable material, such as vinyl plastic, with a drainage hole and cover, air trap valve, a battery operated air pump, plastic tubing, a carrying case, and associated interconnecting components.

A battery operated air pump is attached to the inflatable liner via small plastic tubes. The air pump is used to inflate the liner. The present invention also has an air trap valve to prevent overinflation. The inflatable liner is composed of separate air reservoir tubes that conform to the shape of the bathtub, surrounding the entire interior surface area of the bathtub. Once inflated, the actual tub itself provides the present invention with its shape and rigidity. A convenient drainage hole with cover is incorporated into the inflatable liner, which allows the user to drain water out of the invention and bathtub before the present invention is removed from the tub. Once removed, the present invention can be easily deflated, cleaned and stored in a convenient, compact storage/carrying case made from a durable material, such as vinyl.

The present invention has numerous potential applications. Since it is a cushioned surface, the air tub could be used to bathe infants, small children, the elderly, and other people who could easily be injured in a tub. The present invention could also be used in medical situations, where a weak, infirm individual could be easily injured in a traditional bathtub. The present invention could also be used in medical situations where an individual recovering from an injury or illness is uncomfortable in a hard tub or where it is necessary to guarantee a sanitary bathing environment.

Of particular concern are the elderly, whose bones are brittle and can easily break from a fall in the tub. The present invention can provide them with the necessary padding that could mean the difference between serious injury and a simple bump. Apart from medical and sanitary applications, the present invention could simply provide a comfortable support device for a pleasurable bathing experience both at home and while traveling.

A feature of the present invention in its preferred embodiment is that it is universal, in that its form fitting air pockets conform to the sides of various shaped bathtubs, including the traditional oval and square bathtub shapes.

Thus, the present invention can be used with most bathtubs. This reduces inventory costs for distributors, and makes consumer purchasing easier. In an alternate embodiment of the present invention, the inflatable liner is custom designed to fit unusual sizes and tub shapes.

Another feature of the present invention is that it is used inside of a traditional bathtub. Thus, no additional space is needed in the home during usage.

Another feature of the present invention is that it can be folded up after use. Thus, no additional space is needed in the home during nonuse.

Another feature of the present invention is that it is compact in its folded form. In a preferred embodiment, the device fits into a carrying case made from a durable, lightweight material, such as vinyl. This makes the present invention easy to store and handle during nonuse, and facilitates its use in hotel bathtubs during travel.

Another feature of the present invention is that it provides a germ barrier between the user and the traditional bathtub. This is important in situations where more than one person uses a particular bath tub, such as hotels and hospitals. This protection is especially important in hospitals, where many diseases are concentrated, and many patients contract diseases while using the bathing facilities. This germ barrier will also allow certain patients to use a bathtub who could not previously do so, such as those suffering from burns. Because the liner is inexpensive to produce, each tenant or patient could be given his or her own liner. The pump could be either reusable or inexpensively manufactured.

Another feature of the present invention is that it provides a cushion barrier between the user and the traditional bathtub. This creates several advantages. First, the problem of getting into a cold, ceramic bathtub is eliminated. Second, the air cushioning effect provides a comfortable environment in which to take a bath. Third, the air cushioning effect of the inflated pockets will ease the pressure on the bodies of hospital patients who are either moderately overweight, are burned or have bedsores. Fourth, the cushion will reduce slip and fall injuries for those who are likely to be more seriously injured if they fell, such as the elderly. Fifth, because more hospital patients can use the device in conjunction with a bathtub, fewer patients will contract bedsores.

Other advantages of the present invention are due to the fact that the present invention is used in combination with a traditional bathtub. First, the present invention maintains the water temperature better than stand alone inflatable bathtubs. This is because the present invention and the traditional bathtub with which it is used have a combined heat retention properties that are superior to that of the stand alone inflatable bath. Second, the likelihood of injury due to falling is lessened because the walls of the present invention are supported by the sturdy walls of the bathtub, which significantly reduces deformation of the liner during entry and exit. This leads to fewer injuries.

Another feature of the present invention is that it is self-inflating. This eliminates the problem of inflating the device, which can be difficult for many people, especially the young, elderly, and infirm.

Another feature of the present invention is that the inflation pump is portable. This facilitates use of the present invention during travel.

Another feature of the present invention is that the portable inflation pump is battery operated. This eliminates the need to have an operational wall outlet in the bathroom, which can be a problem in hotels. Using a battery power source also helps eliminate the fear of some individuals, however unfounded, of being electrocuted while in the bathtub.

Another feature of the present invention is its air trap valve. This component assures that the device will not rupture due to overinflation.

Another feature of the present invention is the drainage apparatus, which allows the water in the tub to drain through the device and down the bathtub drain before the device is removed from the bathtub. This is advantageous in that it reduces the time and strain associated with removing the device from the bathtub after use.

Another feature of the present invention is that the operator uses the bathtub's water supply and faucet. This makes filling and emptying the tub, with the liner in place, easy. No hoses or tubes are necessary to direct the water flow.

Another feature of the present invention is that it is made from a strong, lightweight, durable material, such as vinyl.

Another feature of the present invention is that it can be manufactured inexpensively, using existing plastic extrusion and heat assembly techniques Another feature of the present invention is that it can be used at home or while traveling.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
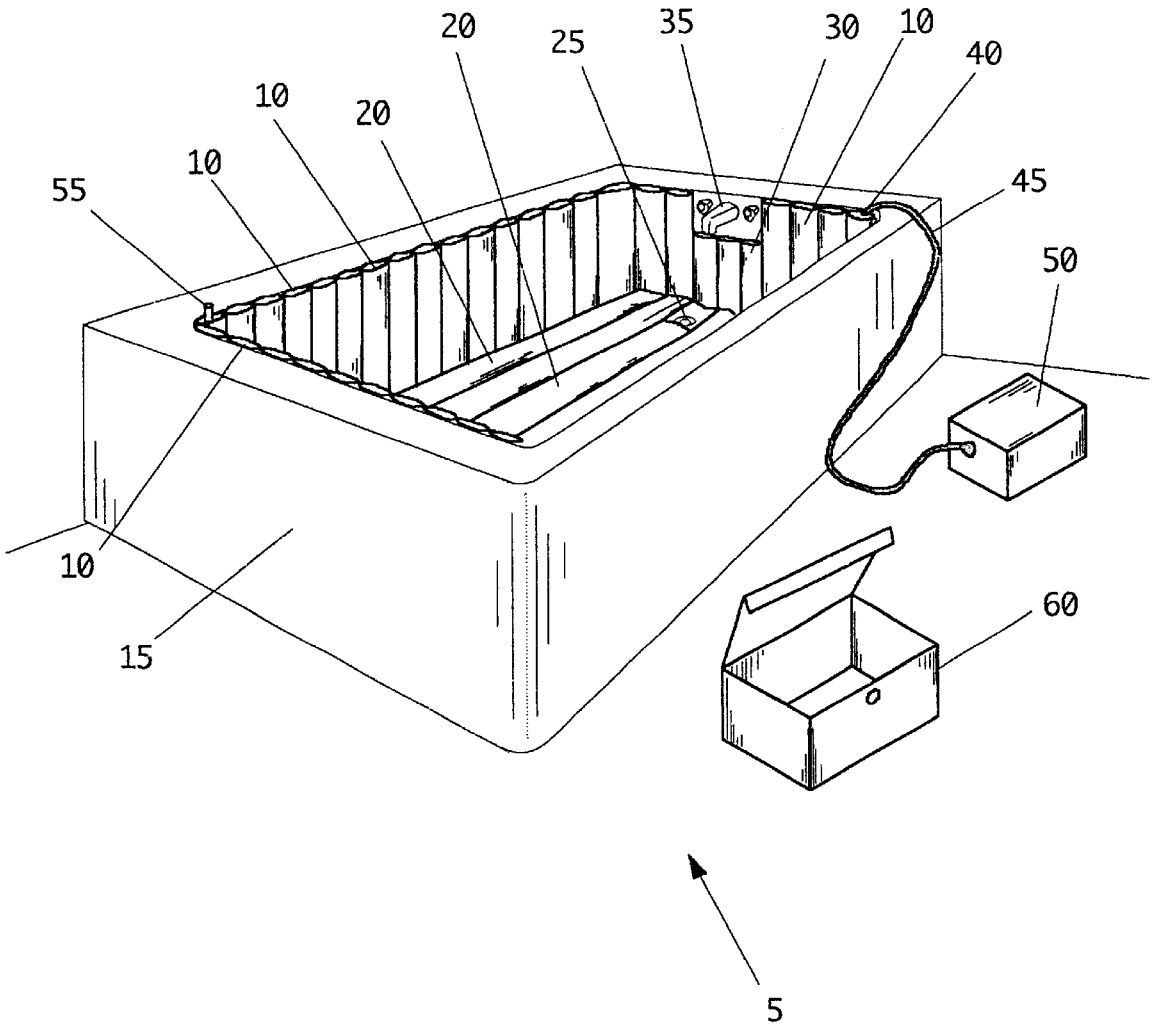
FIG. 1 is a perspective view of the portable, universal, self-inflating, bathtub liner according to a preferred embodiment of the present invention.

Referring now to FIG. 1 is a perspective view of a portable, universal, self-inflating, bathtub liner 5 according to a preferred embodiment of the present invention. A plurality of vertical inflated tube cushions 10 is positioned around the inside of the total outer perimeter of a conventional bathtub 15. It is envisioned that the vertical inflated tube cushions 10 would be manufactured from a lightweight, flexible, vinyl product with properties that allow for ease of cleaning, puncture and tear resistance, waterproof, resistance to cleaning compounds and the like. It is clearly seen by those familiar in the art that while a plastic vinyl compound will meet these characteristics, other materials, readily available today, and those yet to be discovered will also meet these characteristics. The joining and construction specifics of the vertical inflated tube cushions 10 will be described in greater detail hereinbelow. A plurality of horizontal inflated tube cushions 20 is positioned along the bottom of the portable, universal, self-inflating, bathtub liner 5 and rests upon the bottom surface of the conventional bathtub 15. The construction of the horizontal inflated tube cushions 20 is identical to that of the aforementioned vertical inflated tube cushions 10 and is physically attached by mechanical means to the vertical inflated tube cushions 10 around their lower periphery. The physical attachment means will be described in greater detail hereinbelow. Positioned near the outer perimeter of the surface composed of the horizontal inflated tube cushions 20 near the end of the lengthwise dimension is a drain flap assembly 25. The construction details and further specifics of the drain flap assembly 25 will be provided hereinbelow. The purpose of the drain flap assembly 25 is to allow the user to drain the portable, universal, self-inflating, bathtub liner 5 after use. Water that was held inside the portable, universal, self-inflating, bathtub liner 5 is released through the drain flap assembly 25 and exits through the conventional tub drain as provided on the conventional bathtub 15. It is envisioned that the drain flap assembly 25 is positioned in near proximity to the conventional tub drain, though a misalignment of up to six inches or more is not seen as a detrimental impact. A faucet cutout area 30 is provided along the upper portion of the vertical inflated tube cushions 10 near the centerline as defined by the lengthwise dimension. The purpose of the faucet cutout area 30 is to allow access to a conventional faucet system 35, which is composed of but not limited to a faucet, hot and cold water spigots, conventional tub drain actuator, shower controls, temperature controls and the like. It is envisioned under ideal circumstances that the faucet cutout area 30 provides complete and unrestricted access to the conventional faucet system 35, however interference of a few inches or more is not seen as detrimental due to the flexible nature of the vertical inflated tube cushions 10. Next, referring to the upper portion of the portable, universal, self-inflating, bathtub liner 5, near the corner surface as defined by the perpendicular junction of the vertical inflated tube cushions 10, the location of an air port 40 is defined. The purpose of the air port 40 is to allow for inflation of the portable, universal, self-inflating, bathtub liner 5 prior to use and for the deflation of the portable, universal, self-inflating, bathtub liner 5 after use. The construction details of the air port 40 are visualized as a friction fit plug 42 with an integral cap 43, though other variations such as a screw fitting or a quick release tap could also be easily visualized. Connected to the air port 40 during the time when the portable, universal, self-inflating, bathtub liner 5 would be undergoing inflation is an inflation tube 45 which would be in turn connected to a battery operated air pump 50. The battery operated nature of the battery operated air pump 50 allows for operation where normal alternating current power is not readily available, or allows for safe operation where fear of electrical shock hazards are present. The air regulating means 55 is of a conventional design similar to those used to inflate air beds, water toys, tires, etc. such that it provides an adequate flow rate and pressure. Located at the diagonally opposite corner from the air port 40 is an air regulating means 55. The purpose of the air regulating means 55 is to release excess pressure during inflation of the portable, universal, self-inflating, bathtub liner 5, or if during initial use of the portable, universal, self-inflating, bathtub liner 5 when the user first steps into the portable, universal, self-inflating, bathtub liner 5, displaced air could cause the portable, universal, self-inflating, bathtub liner 5 to exceed its safe pressure rating. In these instances, a release of the excess air pressure by the air regulating means 55 would preserve the structural integrity of the portable, universal, self-inflating, bathtub liner 5. Finally a storage means 60 is disclosed for the storage and transport of the portable, universal, self-inflating, bathtub liner 5. The storage means 60 affords a means to provide ease of carrying the portable, universal, self-inflating, bathtub liner 5 in its deflated state as well as protection against tears or punctures in addition to keeping the portable, universal, self-inflating, bathtub liner 5 in a clean state.

Figure 2:
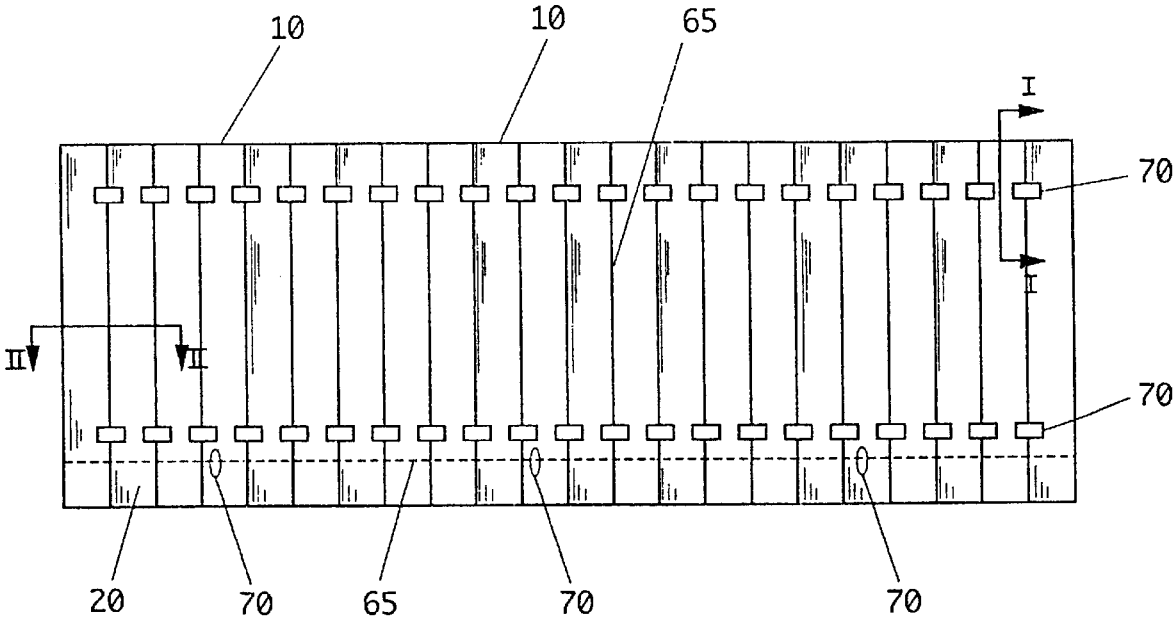
FIG. 2 is a side elevation of the present invention.
Figure 2A:
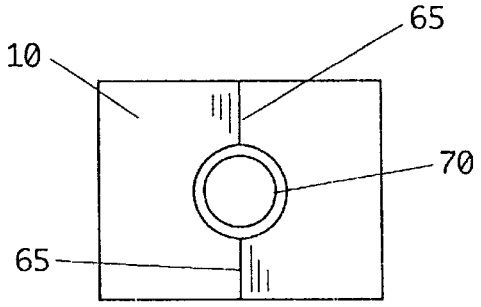
FIG. 2*a* is sectional view of the present invention as seen along a line I—I as shown in FIG. 2.

Referring next to FIG. 2, a side elevation of the present invention is disclosed. The vertical inflated tube cushions 10 are connected together along their linear axis perpendicularly tangent to one another as shown. An attachment means 65 such as adhesive, thermal or heat fusion, or the like is used to join the plurality of individual vertical inflated tube cushions 10 together. A pair of air passage ports 70 is located in each seam formed by the attachment means 65 as depicted. The purpose of the air passage ports 70 is to allow passage of air during inflation and deflation from one vertical inflated tube cushion 10 to another. This detail is further clarified in FIG. 2A which shows the air passage ports 70 in elevational view as taken along a line I—I in FIG. 2. In a similar manner air passage ports 70 are located in the seam formed by the attachment means 65 between the vertical inflated tube cushions 10 and the horizontal inflated tube cushions 20. This manner of interconnecting all inflatable components of the portable, universal, self-inflating, bathtub liner 5 via a redundant loop system composed of the air passage ports 70 allows the portable, universal, self-inflating, bathtub liner 5 to be inflated from the singular air port 40 (as shown in FIG. 1) thus eliminating multiple inflation points. The same manner also allows for increased rigidity of all components as afforded by the individual cell construction of the vertical inflated tube cushions 10 and the horizontal inflated tube cushions 20.

Figure 3:
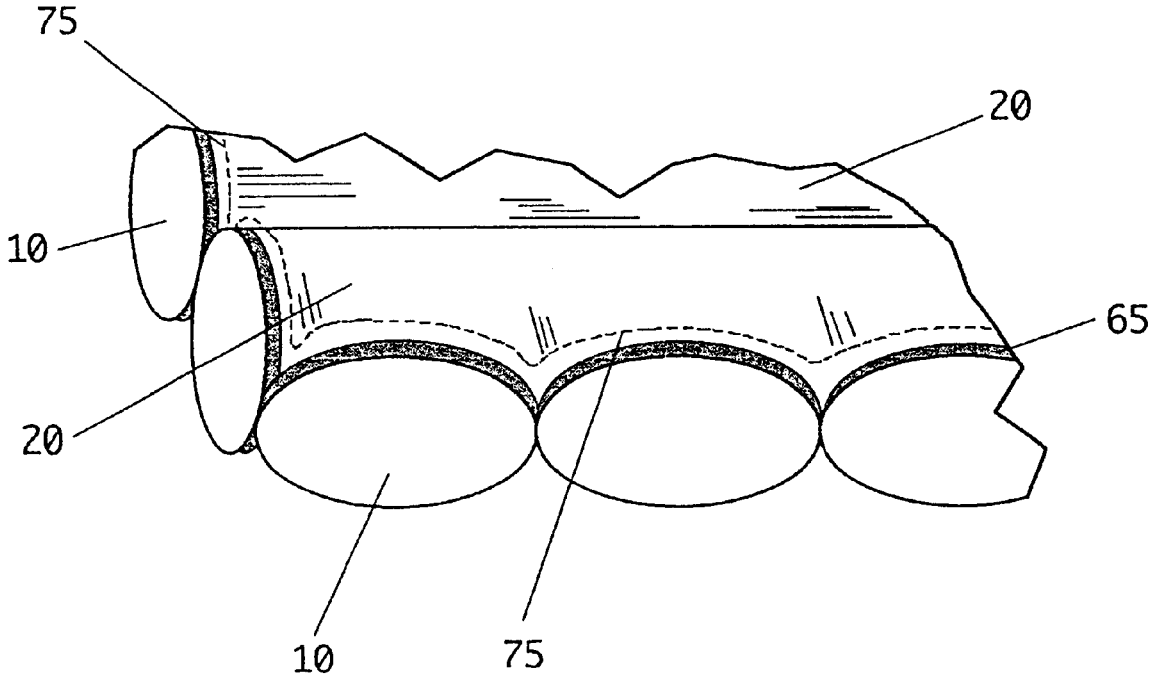
FIG. 3 is a sectional view of the present invention as seen along a line II—II in FIG. 2.

Referring now to FIG. 3, a sectional view of the present invention as seen along a line II—II in FIG. 2 is depicted. It is envisioned that the seam formed by the attachment means 65 between the individual vertical inflated tube cushions 10 and the individual horizontal inflated tube cushions 20 in both their longitudinal and latitudinal dimension is enhanced by the coping of the vinyl material to allow for ease of construction as well as overall strength. This line is defined by a coped material line 75 shown as a dashed line in this FIG.

Figure 4:
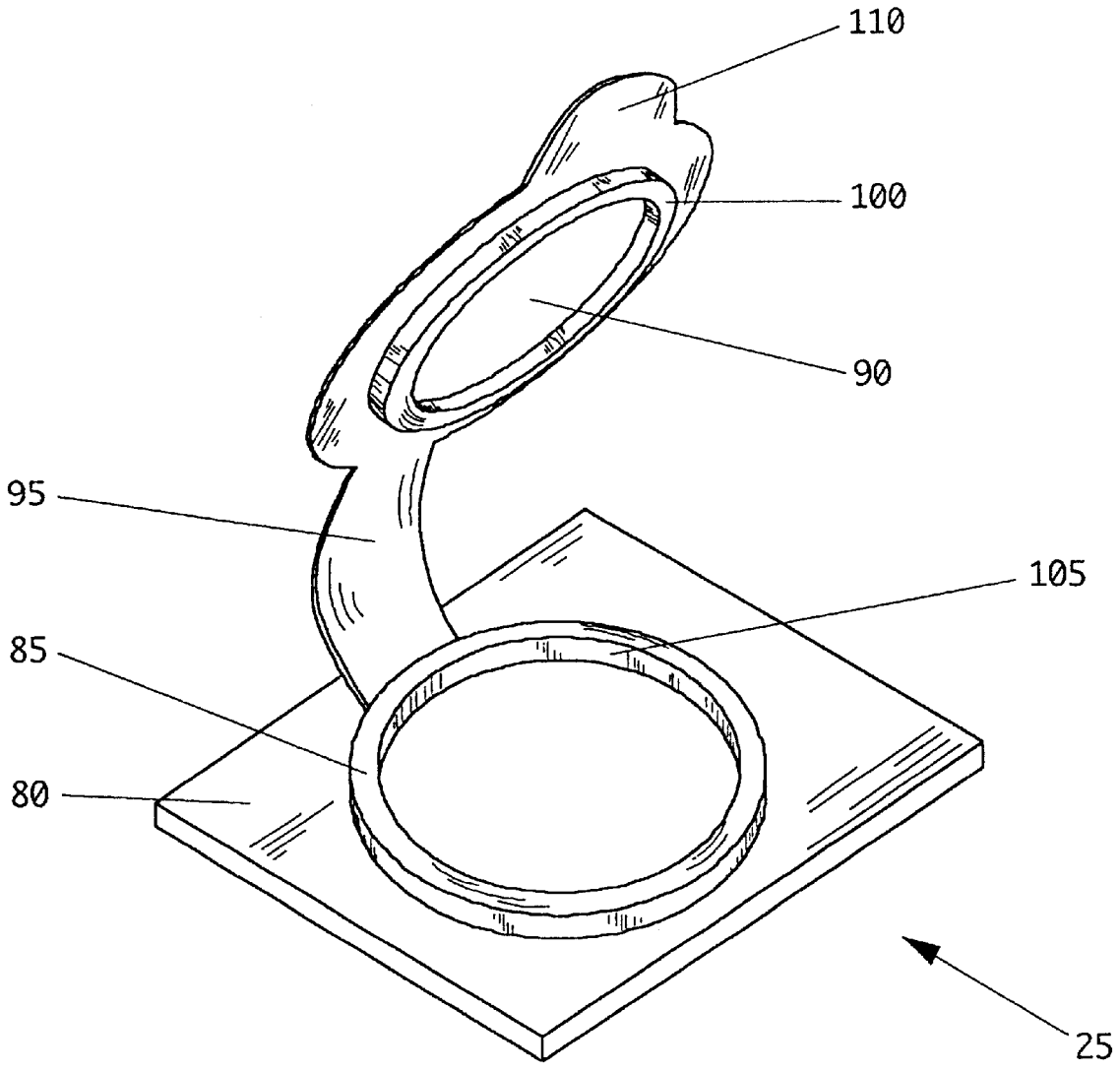
FIG. 4 is a perspective view of a drain flap assembly as utilized by the present invention.

Referring finally to FIG. 4, a perspective view of the drain flap assembly 25 is disclosed in further detail. The drain flap assembly 25 is composed of a drain flap flange 80 in which a retaining ring 85 is center mounted. Forming an integral part of the retaining ring 85 is a cover assembly 90, connected via an integral flexible cover hinge 95. The drain flap assembly 25 is closed by simply placing the cover assembly 90 over the retaining ring 85, as guided by the automatic centering action of the flexible cover hinge 95 and applying pressure until a cylindrical extrusion 100 on the cover assembly 90 is seated against a matching extrusion receptacle 105 on the retaining ring 85. To open the drain flap assembly 25 one would grasp an opening handle 110 on the cover assembly 90 and apply an upward pressure until the physical friction between the matching extrusion receptacle 105 and the opening handle 110 is overcome and the cover assembly 90 is separated from the retaining ring 85 as limited by the pivoting action of the flexible cover hinge 95. It is envisioned that the opening afforded by the drain flap assembly 25 is of the magnitude of approximately 2 inches to allow for the rapid release of water after use of the portable, universal, self-inflating, bathtub liner 5 (not shown in this FIG.) as described in the aforementioned FIG. 1.

2. Operation of the Preferred Embodiment

In operation, the present invention can be easily utilized by the common user is a simple and effortless manner. To use the present invention with its preferred embodiment can best be described in conjunction with the perspective view of FIG. 1, the side elevational view of FIG. 2, the sectional view of FIG. 2*a,* the sectional view of FIG. 3, and the perspective view of FIG. 4. The user would first begin by removing the portable, universal, self-inflating, bathtub liner 5 from its storage means 60 and unfolding it in a conventional bathtub 15 in its dry state. Next the inflation tube 45, connected to its battery operated air pump 50 is connected to the air port 40, and the battery operated air pump 50 is activated. Air as compressed and forced by the battery operated air pump 50 passes through the inflation tube 45 and into the first vertical inflated tube cushions 10 where it begins inflation. Air, by its physical property and desire to equalize pressure, then begins to flow to the neighboring vertical inflated tube cushions 10 in a linear fashion, and then on to the horizontal inflated tube cushions 20 via passage through the air passage ports 70. The portable, universal, self-inflating, bathtub liner 5 will continue to inflate in said manner until it contacts and is physically restrained by the conventional bathtub 15, at which point the portable, universal, self-inflating, bathtub liner 5 will begin to form to the interior contour of the conventional bathtub 15. When full inflation is reached, either by indication of release of pressure by the air regulating means 55 or by a level that is desirous to the user, the user would then deactivate the battery operated air pump 50, remove the inflation tube 45 from the air port 40 and close the air port 40 in a conventional manner. Next, the user would close the drain flap assembly 25 and turn on the conventional faucet system 35 to fill the portable, universal, self-inflating, bathtub liner 5 with water of the desired temperature in a conventional manner. When the desired water level inside the portable, universal, self-inflating, bathtub liner 5 is reached, the user would deactivate the conventional faucet system 35 and perform bathing duties, either on his or herself, or children, injured or elderly assigned to the user's care. Bathing would take place in a safe manner void of any physical danger associated with falling and/or firm contact with the conventional bathtub 15. When bathing duties are complete, the user would open the drain flap assembly 25 in the aforementioned manner and allow the water to drain from the portable, universal, self-inflating, bathtub liner 5, through the conventional tub drain, and out through the waste piping. The portable, universal, self-inflating, bathtub liner 5 could then by cleaned and/or dried if desired. If the portable, universal, self-inflating, bathtub liner 5 is to be removed from the conventional bathtub 15 to allow for its return to duty as a conventional bathtub, the user would open the air port 40 and allow for the air to escape in a conventional manner by the equalization of air pressure between ambient air and pressurized air in the portable, universal, self-inflating, bathtub liner 5. It is envisioned that an enhancement to the present invention would allow for the air to be removed from the portable, universal, self-inflating, bathtub liner 5 by physical means by the establishment of a vacuum to rapidly equalize the pressure, such as permitted by the reversal of the battery operated air pump 50 in operation. Once in its deflated state the portable, universal, self-inflating, bathtub liner 5 could be folded and stored in the storage means 60.

The foregoing description is included to illustrate the operation of the preferred embodiment and is not meant to limit the scope of the invention. The scope of the invention is to be limited only by the following claims.

What is claimed is:

1. A portable, universal, self-inflating, bathtub liner comprising:

a plurality of vertical inflated tube cushions adapted to be positioned around the inside of the total outer perimeter of a conventional bathtub, said vertical inflated tube cushions being connected together along their linear axis perpendicularly tangent to one another and forming a pair of air passage ports for allowing communication of air during inflation and deflation from one vertical inflated tube cushion to another;

a plurality of horizontal inflated tube cushions positioned along the bottom of the portable, universal self-inflating, bathtub liner and adapted to rest upon the bottom surface of the conventional bathtub and physically attached to the vertical inflated tube cushions around their lower periphery, said horizontal inflated tube cushions being connected together along their linear axis perpendicularly tangent to one another and forming a pair of air passage ports for allowing communication of air during inflation and deflation from one horizontal inflated tube cushion to another; and a drain flap assembly, said drain flap assembly positioned near the outer perimeter of the surface composed of the horizontal inflated tube cushions near the end of the lengthwise dimension; and wherein water that is held inside the portable, universal, self-inflating, bathtub liner is released through the drain flap assembly and exits through the conventional tub drain as provided on the conventional bathtub.

2. The bathtub liner of claim 1, wherein said vertical inflated tube cushions are manufactured from a lightweight, flexible, vinyl product with properties that allow for ease of cleaning, puncture and tear resistance, waterproof, and resistance to cleaning compounds.

3. The bathtub liner of claim 2, wherein horizontal inflated tube cushions are manufactured identical to that of said vertical inflated tube cushions.

4. The bathtub liner of claim 1, wherein said drain flap assembly is positioned in near proximity to the conventional tub drain.

5. The bathtub liner of claim 1, further comprising:

a faucet cutout area along the upper portion of the vertical inflated tube cushions near the centerline as defined by the lengthwise dimension for allowing access to a conventional faucet system.

6. The bathtub liner of claim 1, further comprising an air port for allowing for inflation of the portable, universal, self-inflating, bathtub liner prior to use and for the deflation of the portable, universal, self-inflating, bathtub liner after use.

7. The bathtub liner of claim 6, further comprising:

an inflation tube for connecting to said air port; and a battery operated air pump in fluid communication with said inflation tube; and an air regulating means for releasing excess pressure during inflation of the portable, universal, self-inflating, bathtub liner.

8. The bathtub liner of claim 1, wherein said drain flap assembly is comprised of a drain flap flange in which a retaining ring is center mounted, and a cover assembly formed integral to said retaining ring and connected via an integral flexible cover hinge.

* * * * *